United States Patent [19]

Tribbett et al.

[11] 3,962,968

[45] June 15, 1976

[54] SELF CLOSING DOOR FOR BALING PRESS

[75] Inventors: Murray C. Tribbett; Nicholas L. Manko, both of Piqua, Ohio

[73] Assignee: The French Oil Mill Machinery Company, Piqua, Ohio

[22] Filed: Feb. 10, 1975

[21] Appl. No.: 548,393

[52] U.S. Cl. ..... 100/215; 100/190; 100/249

[51] Int. Cl.[2] ..... B30B 15/30

[58] Field of Search ..... 100/215, 190, 45, 249; 214/23, 83.3; 110/109

[56] References Cited

UNITED STATES PATENTS

| | | | |
|---|---|---|---|
| 2,630,063 | 3/1953 | Paradise | 100/190 X |
| 3,252,600 | 5/1966 | Brisson et al. | 214/83.3 X |
| 3,765,321 | 10/1973 | Newell | 100/215 X |

*Primary Examiner*—Billy J. Wilhite

*Attorney, Agent, or Firm*—Biebel, French & Nauman

[57] ABSTRACT

A baling press including a cavity, having separate loading and unloading openings near its opposite ends, a bolster which moves in the cavity to reduce the volume of the cavity and compress the material loaded therein to a predetermined size, a ram connected to reciprocate the bolster within the cavity between a retracted position clear of the loading opening and an advanced position beyond the loading opening, and a door linked to a cooperating cam and a follower means mounted one to reciprocate with the ram and the other to control the motion of the door whereby movement of the bolster from its retracted position to its advanced position in a compression stroke will automatically close the door until the bolster returns to its retracted position.

5 Claims, 3 Drawing Figures

SELF CLOSING DOOR FOR BALING PRESS

CROSS REFERENCE TO RELATED APPLICATION

This application is related to copending application Ser. No. 540,800, filed Jan. 14, 1975, entitled "Baling Press with Replaceable Wear Strips and Replaceable Liner and Control Therefor."

BACKGROUND OF THE INVENTION

This invention relates generally to a baling press used in compressing loose material to effect a reduction in volume and form the material into a block or bale of a predetermined size, and specifically to a door arrangement for the loading chute for such a press.

Baling presses are used to produce compressed bales of synthetic polymeric materials from loose tacky synthetic crumb. The use of hydraulic baling presses for this general purpose has been well known.

Typically in prior art baling presses the bolster performing compression of the crumb material reciprocates vertically, and the loose crumb material is loaded into the press cavity prior to compression through the same opening used to discharge the compressed material. A retractable chute is used to supply the loose crumb material to the press cavity through the single opening, and the chute is then retracted so as to allow discharge of the compressed material.

SUMMARY OF THE INVENTION

The present invention generally provides an improved baling press which uses separate loading and unloading openings so that the press may operate faster, and specifically provides a door arrangement which will automatically allow or prevent flow of material through the loading opening during the various cycles of the pressing operation.

The basic press structure comprises a cavity, having separate loading and unloading openings near its opposite ends, and in which a bolster moves to reduce the volume of the cavity and compress the material loaded therein, to a predetermined size, e.g., a bale. The loading opening includes a chute through which loose material, such as loose tacky synthetic polymeric crumb, can pass into the cavity. A ram is connected to reciprocate the bolster within the cavity between a retracted position clear of the loading opening and an advanced position beyond the loading opening.

The loading chute need not be moved out of the way during the compression step, and by having the loading opening near one end of the chamber, in the upper wall of the press cavity, and the unloading opening near the other end, the improved press utilizes a faster, smoother "flow through" technique. Substantial compression of the crumb material will not occur until the bolster has moved past the supply opening, so that the door, which is used to control the flow of material through the loading opening, is not subjected to the forces produced during compression of the material.

In order to prevent in-flow of the material during the compressing and discharging operations the door closes off the loading opening. A cooperating cam and follower means is used to close the door automatically during the beginning of the compression step, and to open the door as the bolster returns to its retracted position. Preferably, the cam is mounted to reciprocate with the ram, while the follower is connected by linkage to the door to control the motion of the door. The cam design is such as to allow the door to close quickly, but seat slowly, to prevent excessive wear which would occur if the door was continually slammed shut.

It is therefore an object of this invention to provide an improved baling press having a door arrangement for its loading opening which will automatically close the door in response to predetermined compressing movement of the ram to stop further flow of loose material through the loading opening.

Other objects and advantages of the invention will be apparent from the following description, the accompanying drawings and the appended claims.

DETAILED DESCRIPTION OF THE INVENTION

Figure 1:
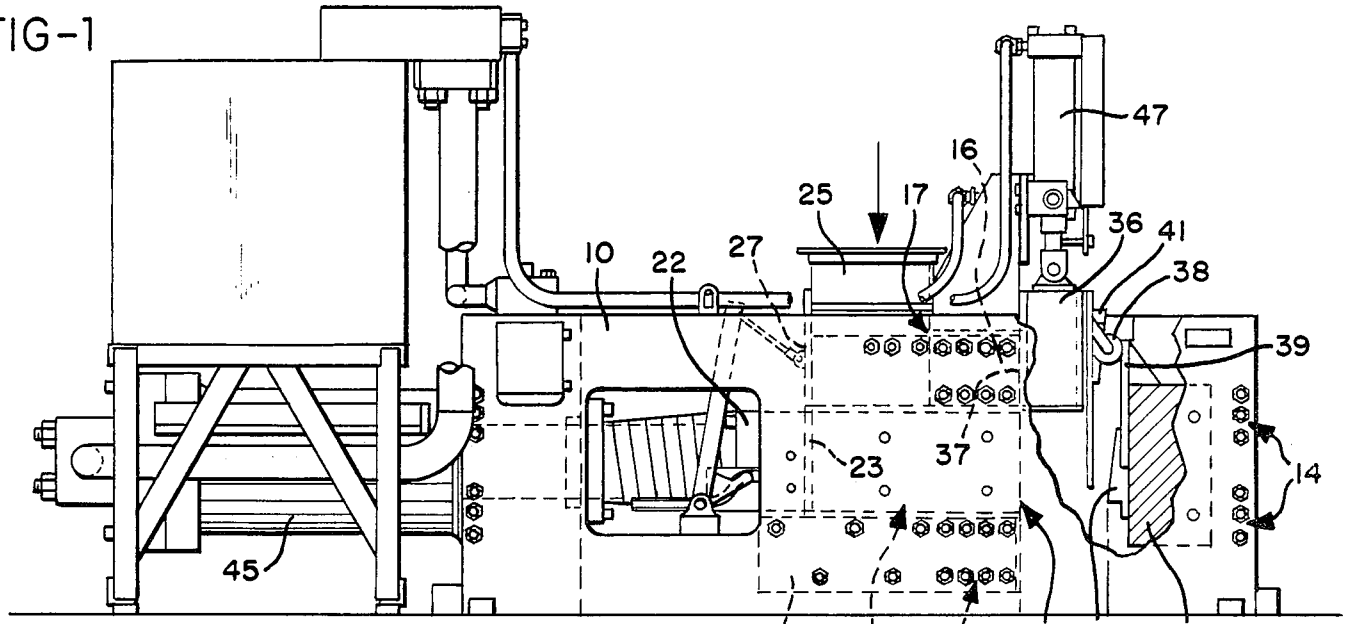
FIG. 1 is a side elevational view, with a portion broken away and shown in section, showing the major components of a typical baling press incorporating the features of the invention.
Figure 2:
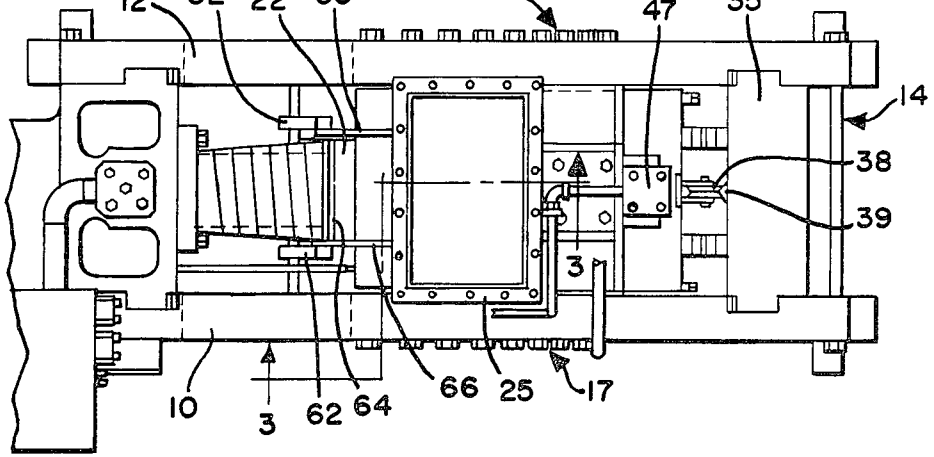
FIG. 2 is a plan view of the press as shown in FIG. 1.

Referring to the drawings, and particularly to FIGS. 1 and 2, the press structure consists of extended side plates 10 and 12 which are connected at opposite ends with a plurality of through bolts designated by the general reference numeral 14. A bottom plate 15 and a top plate 16 are held in place by additional studs 17, extending between the side plates and appropriately fitted thereinto.

As seen in FIG. 1, the bottom plate 15 extends from the bale discharge opening 20 between the side plates, rearwardly or to the left to the retracted position of the bolster 22. In this position, the face 23 of the bolster is vertically aligned with the rearward edge of the loading opening or feed chute 25, which communicates with the press cavity 26 through a pivoting door 27. The upper plate 16 is shorter, and extends from the plane of one edge of the discharge 20 rearwardly to the edge of the feed chute 25.

Appropriate keys (not shown), comprising longitudinally tapered strips, are tapped into place after bolts 17 are tightened so as to exert an upward pressure on bottom plate 15 and a downward pressure on top plate 16, and allow replaceable liner pieces to be used to line the sides of cavity 26. Details of the replaceable liner pieces and key strips form the subject matter of related U.S. Patent application, Ser. No. 540,800.

The press head 35 is supported between the side plates 10 and 12, spaced on the opposite side of the bale discharge or unloading opening 20, and a vertically movable cover or gate 36 is supported at the top of the discharge, capable of moving vertically from its open position, as shown in FIG. 1, to a closed position where one face 37 of the gate functions as an end wall of the cavity 26.

Movement of the gate 36 is guided by roller 38 which operates in a track 39 that is supported on the center of the head 35. In addition, cooperating wedges 41, on the gate, and 42, on the head, are arranged to contact each other in the closed position of the gate, firmly supporting it against the thrust of material being compressed in the cavity by the movement of the bolster 22.

The bolster 22 is driven by a double acting hydraulic ram which is shown at 45, and the gate 36 is operated by a double acting hydraulic cylinder 47. The door 27 is moved between its open and closed positions by a means discussed in more detail hereinafter.

In a normal cycle of operation, gate 36 is closed, the cavity is filled with a measured charge of material which is fed to the cavity via the feed chute 25, and ram 45 moves the bolster 22 forward, while the door 27 is closed, and compresses the material within the cavity 26 against the gate 36. The stroke of the ram is halted when the material is compressed to the desired thickness within the end of the cavity at the gate 36. In the case of crumb synthetic polymers, the pieces are sufficiently tacky that they adhere together and form an essentially self-supporting block or bale. The gate is then withdrawn upwardly, and ram 45 moves the bolster further forward until its face 23 aligns with the edge of the cavity at the discharge opening 20. The gate 36 then is moved downwardly by cylinder 47, functioning to push the compressed block or bale of material down and away from the discharge 20, and to wipe it from the face of the bolster in the event there is any sticking of the bale to the face. This same motion again moves the gate to its closed position and the ram 45 withdraws the bolster to its starting position as shown in FIG. 1. Details of the complete cycle and the supply of crumb to the press, as from a scale, are disclosed in said copending application, Ser. No. 540,800, filed Jan. 14, 1975.

Figure 3:
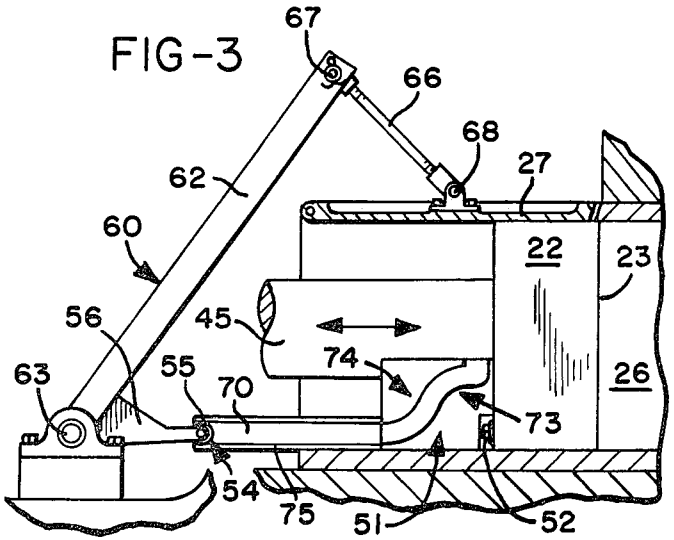
FIG. 3 is an enlarged view, partially in elevation and partially in cross-section, of the door arrangement for the loading chute employed in the press shown in FIG. 1.

In order for the door 27 to open automatically, so that material will flow into cavity 26 via feed chute 25, and to close automatically so that further flow of material is prevented when the bolster 22 begins its compression stroke, a cam and follower arrangement connected to door 27 by linkage means is provided as shown in FIG. 3. Door 27 is mounted to the press by hinge 50, so that door 27 will pivot about hinge 50 from the closed position (FIG. 3) to the open position (FIG. 1). In the closed position, door 27 forms a part of the upper wall to cavity 26, while in the open position, door 27 forms part of feed chute 25.

Identical cams 51 are located on either side of ram 45 and are attached by bolts 52 to the rear of bolster 22. In this way cams 51 will reciprocate with ram 45. Followers 54 ride in the cams 51, and comprise rollers 55 carried at the end of short arms 56. Arms 56 are connected by linkage 60 to door 27 and cause the door to open and close in response to the movement of follower 54 in cam 51.

Linkage 60 comprises long arms 62 angularly and fixedly connected to arms 56. Both the short and long arms pivot about pivot pins 63, which are suitably mounted on the press frame. Arms 62 are joined together by a cross arm 64, so that arms 62 will work together, and are pivotally connected to door 27 by rods 66 which have pivotal connections 67 at one end to arms 62, and at their other ends 68 to door 27.

Cam 51 is designed to close door 27 quickly as ram 45 begins moving from its retracted position (FIG. 1) to its advanced position (not shown) in its compression stroke. But, the cam is also designed so that door 27 will seat slowly once it's in the closed position to prevent door 27 from being worn excessively by continually being slammed shut. Because the press is designed for operation at a comparatively rapid rate, for example in the order of three bales per minute, rapid seating of the door will result in quick wear. Therefore, the actual seating of the door is done relatively slowly compared to the closing of the door. Further, since substantial compression of the material will not occur until the bolster has moved past the supply opening 25, it is not necessary that the door form a perfect seal.

As shown in FIG. 3, the cam 51 comprises channel or slot 70 receiving the roller 55 of the follower 54. Channel 70 includes three shapes or cam surfaces which together describe an essentially S-shaped curve having an elongated lower end. The first part 73 of channel 70 is approximately convex and causes the door 27 to move rapidly from the open position (FIG. 1) to an almost closed position. The second part 74 has a reverse curvature and causes door 27 to become seated. The final segment 75 is connected to segment 74, is straight and maintains the door 27 in the closed position while the pressing operation is completed. When follower 54 is in the straight portion 74, the bolster 22 will be in the extended positions, i.e., compressing and discharging the bale.

The pressing operation begins with the bolster 22 in the retracted position and the cam follower 54 initially resting in the upper portion 73 of the camming channel 70. The door 27 is in the open position shown in FIG. 1, and the gate 36 covers discharge opening 20. As the compression stroke begins, hydraulic force is applied to ram 45 causing bolster 22 and cams 51 to move axially, i.e., left to right as shown in FIG. 3, into cavity 26. As cams 51 move, cam followers 54 will move down cam portions 73 to cam portions 74. As followers 54 move downward, so do arms 56 to which followers 54 are attached, causing long arms 62 to swing about pivots 63. The movement of arms 62 causes door 27 to pivot about hinge 50 from the open to the closed position. As follower 54 moves through cam portion 74, arms 56 and 62 turn about pivots 63, but at a slower rate because of the slope of segment 74. This slowing movement seats the door 27 at a slower rate than it was closed so as not to slam it shut. Once linear segment 75 is reached, all movement of arms 56 and 62 has ceased and the door 27 is closed. The length of segment 75 is not critical, but is at least long enough to hold the door closed until the leading edge of the bolster had cleared it.

When the bolster 22 is moved from the extended or advanced position to the retracted position, the movement of the cam will be the reverse of that described above. The door 27 will quickly move from the closed position to the open position, and then slowly seat in the wall of the feed chute 25 from which position the door 27 started. The door 27 will thereafter remain in the open position until a new cycle and forward movement of the bolster 22 is started.

While the form of apparatus herein described constitutes a preferred embodiment of the invention, it is to be understood that the invention is not limited to this precise form of apparatus and that changes may be made therein without departing from the scope of the invention.

What is claimed is:

1. In a baling press having means defining a cavity with loading and unloading openings, door means controlling said loading opening, a bolster movably supported in said cavity and arranged to move past said loading opening to reduce the volume of said cavity and compress material loaded therein, a ram connected to reciprocate said bolster within said cavity between a retracted position clear of said loading opening and an advanced position beyond said loading opening, the improvement comprising means pivotally mounting said door means for movement between an open position extending above said cavity and in a plane transversely of the path of movement of said ram and a closed position extending across said loading opening, cooperating cam and follower means mounted one to reciprocate with said ram and the other to move said door means to its closed position in response to advancing movement of said bolster from its retracted position in a compression stroke and to hold said door means closed until said bolster returns to its retracted position.

2. A press as defined in claim 1, wherein said loading opening is defined by a chute discharging into said cavity, and said door means in its open position forms at least a part of at least one wall of said chute.

3. A press as in claim 1 wherein said cam is mounted to reciprocate with said ram and said follower means is connected to control the opening and closing motion of said door means, said cam and follower means being constructed and arranged to close said door means with a decellerating motion.

4. A press as in claim 3 wherein said cam is a shaped channel, and said follower means comprises a roller mounted to travel in said channel, and linkage means connecting said roller to said door means whereby roller movement along said channel causes said door means to pivot between open and closed positions as said ram is retracted and advanced.

5. A press as in claim 3 wherein said follower means comprises a roller, a first arm having said roller rotatably mounted thereon, a second arm angularly fixed to said first arm, means pivotally mounting both said arms to a fixed pivot point, a link connecting said second arm to said door means, and means pivotally mounting said door means to said press adjacent to said loading opening whereby said follower means is forced to move in an arc about said fixed pivot point by reciprocating motion of said cam and said second arm pivots about said fixed pivot point to cause said door means to pivot about its mounting between open and closed positions.

* * * * *